US008286373B2

(12) United States Patent
Jones et al.

(10) Patent No.: US 8,286,373 B2
(45) **Date of Patent: *Oct. 16, 2012**

(54) FOOTWEAR WITH BANDING DEVICE

(75) Inventors: Lindell B. Jones, Wildwood, MO (US); Donald R. Cox, Wildwood, MO (US); Raymond F. Tonkel, Sudbury, MA (US)

(73) Assignee: U Turn Sports Co., LLC, Wildwood, MO (US)

( * ) Notice: Subject to any disclaimer, the term of this patent is extended or adjusted under 35 U.S.C. 154(b) by 89 days.

This patent is subject to a terminal disclaimer.

(21) Appl. No.: 12/802,232

(22) Filed: Jun. 2, 2010

(65) Prior Publication Data

US 2010/0299964 A1 Dec. 2, 2010

Related U.S. Application Data

(63) Continuation of application No. 11/337,396, filed on Jan. 23, 2006, now Pat. No. 7,748,145.

(60) Provisional application No. 60/646,438, filed on Jan. 24, 2005.

(51) Int. Cl.
*A43B 23/00* (2006.01)

(52) U.S. Cl. ..... 36/136; 36/100

(58) Field of Classification Search ..... 36/136, 36/137, 100, 101, 25 R, 28, 15
See application file for complete search history.

(56) References Cited

U.S. PATENT DOCUMENTS

| | | | | |
|---|---|---|---|---|
| 4,115,933 | A | 9/1978 | Chiaramonte, Jr. | |
| 4,258,482 | A | 3/1981 | Salamon | |
| 4,697,362 | A | 10/1987 | Wasserman | |
| 4,712,319 | A | 12/1987 | Goria | |
| 4,722,477 | A | 2/1988 | Floyd | |
| 4,766,682 | A * | 8/1988 | Malloy, III | 36/132 |
| 5,117,567 | A | 6/1992 | Berger | |
| 5,195,256 | A | 3/1993 | Kim | |
| 5,195,783 | A | 3/1993 | Lavoie | |
| 5,473,518 | A | 12/1995 | Haber | |
| 5,496,612 | A * | 3/1996 | Ransbottom | 428/99 |
| 5,615,497 | A | 4/1997 | Meschan | |
| 6,000,704 | A | 12/1999 | Balbinot et al. | |
| 6,030,089 | A | 2/2000 | Parker et al. | |
| 6,112,437 | A | 9/2000 | Lovitt | |
| 6,574,887 | B2 | 6/2003 | Jones et al. | |
| 6,754,985 | B1 | 6/2004 | Lin et al. | |
| 6,851,204 | B2 | 2/2005 | Aveni et al. | |
| 6,931,766 | B2 * | 8/2005 | Greene | 36/101 |
| 6,962,009 | B2 | 11/2005 | Meschan | |
| 6,968,636 | B2 | 11/2005 | Aveni et al. | |
| 7,028,420 | B2 | 4/2006 | Tonkel et al. | |
| 7,076,890 | B2 * | 7/2006 | Grove et al. | 36/15 |
| 7,325,337 | B2 | 2/2008 | Cox | |
| 7,328,527 | B2 * | 2/2008 | Goldman | 36/100 |
| 7,331,122 | B2 * | 2/2008 | Januszewski et al. | 36/11.5 |
| 7,497,036 | B2 * | 3/2009 | Rhodes-Vivour | 36/136 |
| 7,748,145 | B2 * | 7/2010 | Jones et al. | 36/136 |
| 7,946,058 | B2 * | 5/2011 | Johnson et al. | 36/25 R |
| 2004/0118016 | A1 | 6/2004 | Tonkel | |

(Continued)

*Primary Examiner* — Marie Patterson
(74) *Attorney, Agent, or Firm* — Paul M. Denk

(57) ABSTRACT

The banding device for application to a segment of footwear, whether it be to the heel, sole, around the vamp portion of the shoe, in any combination thereof, which due to its elasticity allows for its stretching into position to be secured either as an endless or continuous loop, for application to these components of the shoe to vary the coloration, design, indicia, trademark, or other aesthetics for the footwear.

8 Claims, 10 Drawing Sheets

U.S. PATENT DOCUMENTS

2004/0128860 A1 7/2004 Smaldone et al.
2004/0255490 A1 12/2004 Wan et al.
2005/0016032 A1 1/2005 Cox et al.
2005/0144812 A1 7/2005 Wheeler et al.
2006/0162193 A1 7/2006 Jones et al.

* cited by examiner

FOOTWEAR WITH BANDING DEVICE

CROSS REFERENCE TO RELATED APPLICATION

This continuation patent application claims priority to the non-provisional patent application having Ser. No. 11/337,396, which was filed on Jan. 23, 2006 now U.S. Pat. No. 7,748,145, which claims priority to the provisional patent application having Ser. No. 60/646,438, which was filed on Jan. 24, 2005; and claims priority to U.S. Pat. No. 7,325,337, having filing date of Jul. 22, 2004; which claims priority to U.S. Pat. No. 7,028,420, having filing date of Nov. 24, 2003.

BACKGROUND OF THE INVENTION

This invention relates generally to footwear, and more specifically pertains to a casual, leisure, outdoor, work, slippers, sandals, and athletic shoes wherein an elastic or other material band, hereafter referred to as the banding device is molded, stitched or otherwise applied to the footwear in any location. The banding device will be of a linear length, and may or may not be molded or formed into a circular band embodiment. The banding device will have various colors, designs, team names, logos, characters, or other indicia, printed, embossed, stitched or otherwise embellished upon one or both sides of the banding device. Therefore, when the banding device is reversed, repositioned or turned over a different color, design, team name, logo, character, or other indicia will be revealed.

In this embodiment the banding device may be permanently attached to the shoe, or be removable, wherein an undetermined number of replacement banding devices may be supplied with the shoe providing the wearer a multitude of choices for decorating or customizing the shoes to reveal different color, design, team name, logo, character, or other indicia. The shoe surface itself at any location of the shoe but with specific emphasis on the midsole, outsole and counter areas may have a groove, channel molded inset, carve out or other indented means to hold the banding device in place. The groove, channel, molded inset, or carve out or other indented means may have a flange or lip design on the midsole, or outersole which will facilitate the banding device from accidentally coming disengaged. The depth of the groove, channel, and the like has sufficient depth to store several of the banding devices upon one shoe. The combination of the banding device material being elasticized with components that expand and retract and the above mentioned groove, molded inset, carve out or other indented means will provide for retention to the shoe regardless if the banding device is permanently affixed or removable. Conversely, there are instances when there is no need for the groove, channel, molded inset, or carve out or other indented means to be used in conjunction with the banding device invention. The banding device, when used on the midsole, outsole, counter or any other part of the shoe, may serve as a closing device to replace traditional shoe laces as later shown in FIG. 16. Further, the banding device may be used on the outsole or midsole, or in combination of the outsole, midsole and other shoe part such as the rear counter, or upper at any position to provide the wearer a customized compression means, wherein the wearer can adjust the tension of the banding device for a firmer, or a softer customized fit in different areas underfoot to allow this invention to be utilized in a technical means that the wearer may desire for whatever activity or change of activity, for example running, bicycling, court activities, walking, cross training, weight lifting, aerobics, yoga, boxing, or any of the other sports activities that modern day performance athletic shoes are used for. In a technical shoe environment, the banding device invention may be affixed or attached to the shoe wherein, there is a closure means to tighten or loosing the tension as preferred by the wearer. In another embodiment the banding device may be removable and several other banding devices may be supplied that are of a different durometers, tension, size, and or shape, material that will provide the wearer with many choices of a custom fit depending on the banding device used. By example one banding device may provide no deflection or torque on impact, another banding device provide medium torque or deflection on impact, and another banding device provide maximum torque or deflection on impact. This banding device can be made of any material such as canvas, nylon or other textile, or of rubber compound, PVC, Polyurethane, TPR, or for that matter any other materials that are used in shoe making that are known to those that are skilled in the art. Further the banding device may be of a pre-molded or fabricated design.

Obviously, numerous styles of footwear, constructed of various components, for achieving a multitude of purposes, have long been considered in the prior art. Most of these types of innovations have been in the area of running or athletic shoes, which has been substantially in vogue for the past three decades, wherein various styles of modifications to the soles, to make them more resilient, or add to the efficiency of the runner, and various types of modifications to the structure of the shoe itself, such as even adding pockets to the side or within the tongue or gusset of the shoe have been considered in the prior art. For example, see the patent to Goria, U.S. Pat. No. 4,712,319, shows footwear with detachable visibility aids. The patent to Floyd, U.S. Pat. No. 4,712,477, shows a scented hunting strap that is adhered to the footwear to mask human odor when the user is hunting. The patent to Haber, et al., U.S. Pat. No. 5,473,518, shows a removable flashing light housing for an athletic shoe, apparently for safety or novelty for children. The patent to Lovitt, U.S. Pat. No. 6,112,437, shows animated display using LEDs for illumination and animation in conjunction with a display panel. The patent to Lin, et al., U.S. Pat. No. 6,754,985, uses a device as a fluorescent bar or strip held in position by fasteners as a decoration or reflective alert stripe.

Furthermore the patent to Wasserman, U.S. Pat. No. 4,697,362, reveals a means for insertion of a trademark logo or other marking, into a groove, held in place by Velcro or cement.

Initially, applicants have already obtained U.S. Pat. No. 6,574,887 relating to a reversible tongue technology, for reversal of the tongue, apart from this innovation of this invention which has a two piece construction with a Track and Slider mechanism.

These are examples of prior art. The current invention seeks further modifications to the structure of footwear, in order to add to the variations on usage of the shoe, enhance its styling, and enhance the attractiveness of the footwear, by providing alternative uses and applications to various components of the footwear itself, in order to provide the wearer with a technical, customized fit for performance improvement in various sport activities.

SUMMARY OF THE INVENTION

This invention contemplates the formation of footwear, preferably of the running, casual or athletic shoe type, but the concepts of this invention may be embodied within any type of shoe, boot, sandal, or slipper as will be readily determined upon reviewing this invention. The footwear includes the usual style of shoe having a sole, vamp, quarter portions, counter, and a tongue or gusset. Further the technical aspects of this invention could be applicable to performance cleated footwear, and other performance athletic footwear.

In the preferred embodiment the banding device will be fastened or otherwise attached to the shoe in any location. The banding device will be printed, embossed, molded, or embroidered on both sides, and when reversed will reveal different color, design, team name, logo, character, or other indicia that is printed, embossed, painted, or otherwise affixed to the banding device. The banding device may be of any design, shape or form, and may be manufactured of any material such as canvas, nylon or other textile, or of rubber compound, PVC, Polyurethane, TPR, or for that matter any other materials that are used that are known to those that are skilled in the art. Further the banding device may be of a pre-molded or fabricated design. The banding device will be of such material that it contracts or expands as as means of affixing to the shoe. In some instances, but not always, a groove, cutout or other indentation may be used on the midsole, outsole, counter or other part of the shoe to facilitate the storage of the banding device to the shoe. Presently people wear wristbands to identify with various causes: cure cancer, find MIA, and the like. Those wristbands being of a resilient material can be used with the groove, channel, and the like of the present invention.

Another embodiment of the banding device may be removable and held in place by the above mentioned groove, cutout, or other indentation and the expandable and contracting properties of the banding device. Therefore in this embodiment the banding device is removable and an undetermined number of replacement banding devices provided wherein the wearer can have any number of choices in customizing the shoe. The banding device and all replacement banding devices can be printed, embossed, molded, or embroidered on both sides, and when reversed, or replaced will reveal different color, design, team name, logo, character, or other indicia that is printed, embossed, painted, or otherwise affixed to the banding device. In this embodiment the banding devices may be of different compression, density and tension, and may be adjustable to the preference of the wearer to offer a firmer or a softer fit depending on the sports activity, for example one banding device for running, and another replacement banding device for basketball, and yet another for tennis, another for walking, another for court games, another for baseball, another for football. In some instances the same compression, density and tension banding device will be applicable to more than one sport or activity.

In another embodiment, the banding device is readily removable from the shoe. The banding device of this embodiment has cooperating hook or loop fastener, Velcro®, portions that temporarily attach to loop or hook portions upon the shoe. The hook and loop fasteners can be readily removed by small children and their caregivers thus lowering the risk of choking in comparison to the elasticized previous embodiment of the band. As the elasticized embodiment contracts around a heel, the elasticized embodiment can readily constrict upon a child, particularly the neck, while the hook and loop fasteners can be separated by a child or caregiver.

In another embodiment the banding device whether permanently attached or removable with an undetermined number of replacement banding devices may be printed, embossed, molded, or stitched on both sides with team colors such as home and away colors, with team logos, and trademarks. Charitable and other organizations and other associations such as Red Cross, Breast Cancer awareness, American Medical Association, American Diabetes, Cancer Association, and other associations and organizations could use banding devices as a means to identify a specific organization or association by using their logos, colors, trademarks and markings on replacement banding devices. Such replacement banding devices could be sold as after market, checkout register or accessory products by retailers with a percentage of the cost going to the charity. Organizations and associations could likewise offer the replacement banding devices with their markings in catalogs, television, radio, print, or internet retailing and advertising. In addition such replacement banding devices can be used commercially by universities, professions, NASCAR®, with various names, trademarks or team logos or characters, or for that matter, by any commercial institution looking to advertise their name and logos.

In yet another embodiment the banding device may be of any design such as circular, triangular, flat, rectangle shape, and others and the groove, channel, molded inset, or carve out or other indented means with flange for security, within the midsole and/or outsole would be the same cutout design or shape as the banding device.

In another embodiment the banding device may wrap under the heel area of the sole towards the back counter of the shoe at an approximate 45 degree angle. Bands already in the marketplace can be used in this invention such as cure cancer bands. The groove, channel, molded inset, carve out, or other indented means would be in the outsole continuing on the counter. Additionally, in this embodiment the groove, channel, molded inset, or carve out or other indented means can be around the outside of the heel part of the midsole, and run at an approximate 45 degree angle around the counter, in order that the wearer may determine which position the banding device be secured, all in the heel area of the midsole, or sloping up at an approximate 45 degree angle.

In yet another embodiment a spool or winder device may be built in as an integral part of the midsole mold and placed in the middle of the outsole/midsole area of the shoe. The spool or winder device would hold the banding device in the same manner as a tape measure housing holds a tape measure, wherein the wearer could unwind the necessary length of banding device to wrap in place in a groove, channel, molded inset, or carve out or other indented means, be it at the toe, or heel area, or other area of the shoe.

Still, yet another embodiment the banding device would be usable in multiple sections of the outsole and midsole area. An additional groove, channel, molded inset, or carve out or other indented means would run from the toe tip to the midfoot area, and another groove, channel, molded inset, or carve out or other indented means would run from the back of the heel to the midfoot area. In this embodiment there would be a space between the raised areas wherein, the banding device could be wrapped to the outside of the toe or heel area, or to the inside of the toe or heel area. This embodiment will allow for a custom performance fit for the wearer as well as a different fashion look.

In another embodiment the midsole areas are raised in the toe and heel part with a lower section between the toe and heel. This will allow for a banding device piece to go around the heel area, and an additional banding device to go around the toe area of the midsole. The groove, channel, molded inset, or carve out or other indented means will be around the toe and the heel area separately to accommodate a banding device in both areas. In this embodiment the banding devices may be attached or removable, and be of different textures and durometers to provide a custom fit for the wearer.

In yet another embodiment the banding device cords may be split with attachments applied to each end, wherein the user can use the banding device cords for stretching prior to or after exercise. With the retracting and expanding properties of the banding device cords the wearer may pull the cords up, down, or sideways, or even overhead to stretch muscles and tissue before or after exercise or exertion.

In another embodiment the banding device cords and devices may be fitted with lights or lighting means whether the banding devices are permanently attached or are removable with many replacement bands. Lighting and lights particularly in children's shoes have been popular the past few years, and the use of lights on the banding device will enhance the options and fashion, plus safety issues for the wearer.

It is therefore, a primary objective of this invention to provide footwear with two or more fashion change appearances utilizing banding device or devices, whether permanently attached or removable with replacement banding devices.

The banding devices will be made out of fabric or textile type material either linear or molded that will have expansion and retraction capabilities to remain secured to the shoe. The banding device can also be made out of rubber or polymer. A groove, channel, molded inset, or carve out or other indented means will be in the midsole, outsole or other area of the shoe, possibly with a flange lipped area which will hold the banding device to the shoe in a permanent or removable configuration. The banding devices will have different colors, designs, team name, logo, trademark, branded mark, character, or other indicia, on both sides of the banding device. When the banding device is reversed it will reveal different colors, designs, team name, logo, trademark, branded mark, character, or other indicia, for a fashion changeable look at the desire of the wearer. Additionally, the banding devices may be produced in different densities, harness, durometers, and thickness, to provide for a technical performance fit, and to facilitate the participation in different sporting activities. Therefore the banding device invention will provide a fashion change or multiple fashion changes for the consumer, as well as technical and performance propensities that will enable a custom firm, medium, or soft fit in strategic areas of the shoe upon impact with the surface, to provide increased performance, and possibly reduce the incident of injuries to the foot.

This and other objects may become more apparent to those skilled in the art upon reviewing the summary of this invention and upon undertaking a study of the description of its preferred embodiment, in view of the drawings.

BRIEF DESCRIPTION OF THE DRAWINGS

FIG. 14A is a side view of the footwear with the banding device installed upon posts;

DESCRIPTION OF THE PREFERRED EMBODIMENT

Figure 1A:
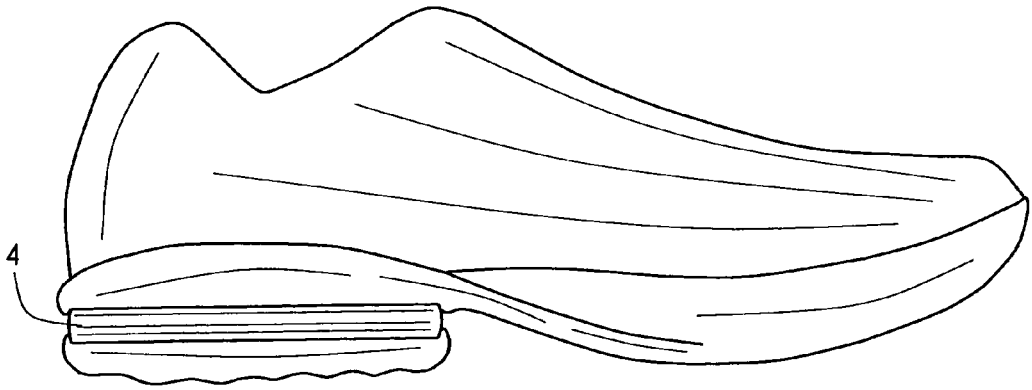
FIG. 1A is a side view of the banding device wrapped around the heel area of the midsole.
Figure 1B:
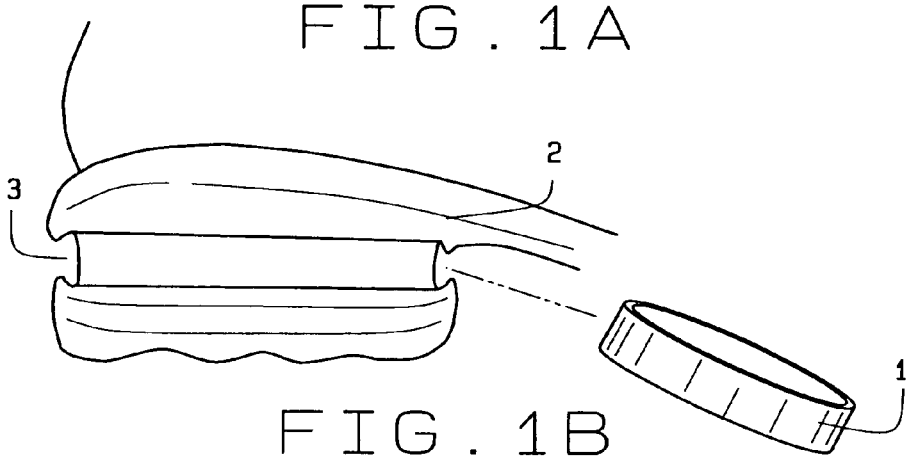
FIG. 1B is a detailed view of the banding device before application to the shoe, and of the groove, channel, molded inset, or carve out or other indented means with flanges top and bottom to hold the banding device securely to the shoe whether the banding is permanently attached or removable.

In referring to the drawings, in particular FIG. 1A is art of a shoe that contains the usual components of an upper consisting of a vamp, quarters, counter, gusset, eyerow, midsole, and outsole. The banding device 1 is manufactured of component materials of textile or other combination materials that allow for expansion and contraction to facilitate the fitting to the shoe whether in a removable or a non removable configuration. The banding device may be permanently attached to the shoe, by stitching, cords, strings, stapling, snaps, or any other type of fastening device familiar to those skilled in the art. Alternatively, the banding device may be removable as by hook and loop fasteners or Velcro® as later shown in FIGS. 15A, 15B wherein, an undetermined number of replacement banding devices may be provided to give the wearer many color or other indicia change possibilities. The banding device will be printed, embossed, molded, or embroidered on both sides, and when reversed will reveal different color, design, team name, logo, character, or other indicia that is printed, embossed, painted, or otherwise affixed to the banding device. The banding device may be of any design, shape or form. Whether the banding device is removable or permanently attached the wearer can change the look of the footwear by simply reversing the banding device. FIG. 1B shows the banding device upon the outsole and midsole 2 part of a shoe wherein a groove, channel, molded inset or carve out will facilitate the storing of the banding device 1. The heel 3 reveals a flange, notch or lip type built in to the midsole or outsole mold which will further secure the banding device 1. The banding device 4 shows the banding device installed to a midsole, and secured. Conversely, in other applications and embodiments there will not be a groove, channel, molded inset or carve out on the midsole or outsole. In these instances the banding device 1 will be of such material that retracts and expands wherein it will stay secured to any part of the shoe without any further attachment means.

Figures 2A, 2B, 2C:
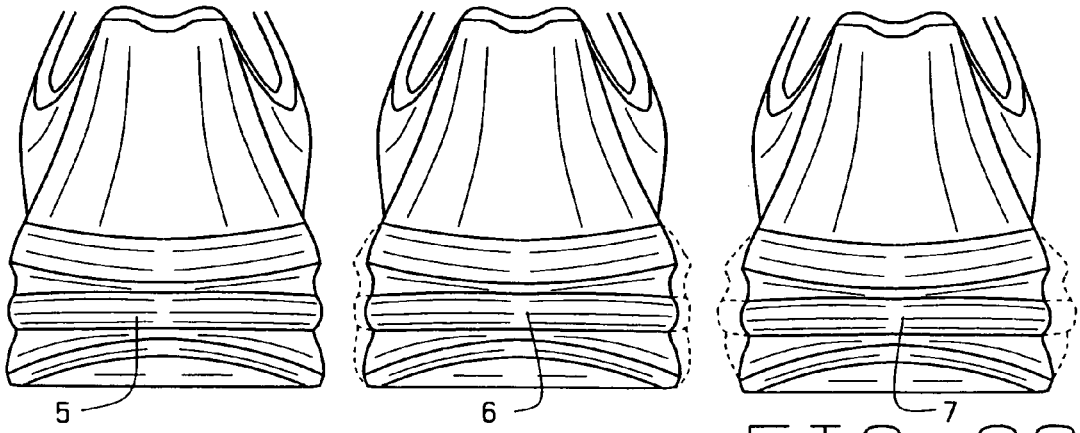
FIGS. 2A, 2B, and 2C are rear views of three different density banding device around the heel part of the midsole to provide a fashion and a performance means to this invention.

FIGS. 2A, 2B, 2C are rear views of three shoes showing the banding device attached in the heel area of the shoe. FIG. 2A reveals a banding device 5 of more rigid component materials that will allow for minimal or no deflection, or torque upon impact with any surface. FIG. 2B reveals a banding device 6 that will be of semi rigid component materials, allowing for medium compression, deflection and torque upon impact. FIG. 2C reveals a softer or pliable banding device 7 that will allow for maximum compression, deflection and torque to the foot upon impact. The attachment of the banding device is the same as described in FIG. 1B, whether removable or attached, and whether used with a groove, channel, molded carve out or not. FIGS. 2A, 2B, 2C reveal the means of a performance, technical athletic shoe wherein the wearer can select the amount of compression be it none, medium, or rigid when the shoe impacts the surface. In many sport activities such as running a customized compression means will afford the wearer a more comfortable, custom fit, as well as prevent injury to the foot. Conversely the embodiment shown in FIGS. 2A, 2B, 2C can be utilized on any part of the shoe, with the preferred embodiment the midsole, outsole, or rear counter areas. In another embodiment the banding device could be used as a fastening closure means wherein the bands secure over the eyerow to replace laces as used in traditional footwear.

Figure 3A:
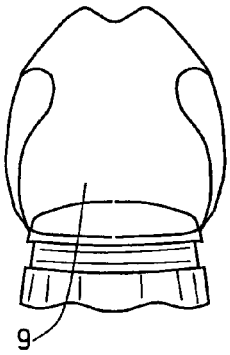
FIG. 3A is a side view of a shoe with the banding device used in both the heel and the toe/midfoot area.
Figure 3B:
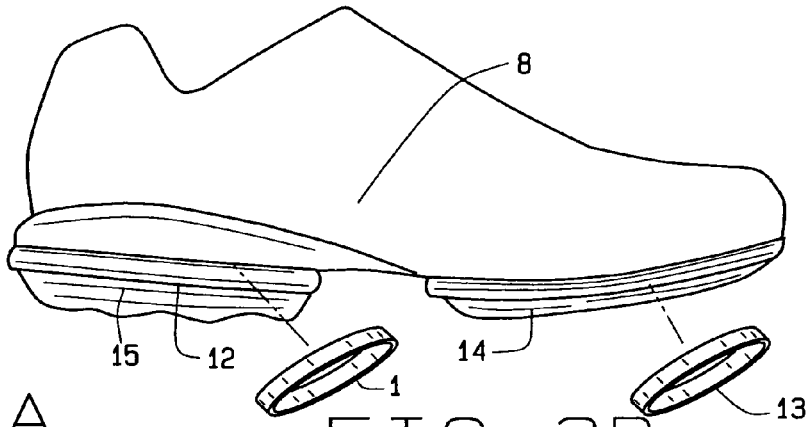
FIG. 3B is a rear view of the shoe showing the groove, channel and the like in the heel.
Figure 3C:
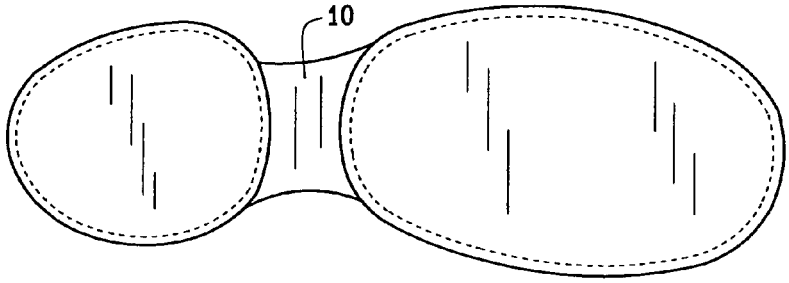
FIG. 3C is a bottom view of the configuration wherein two banding devices are used.

FIG. 3A is the art of a shoe showing a full length view 8, a rear view FIG. 3B of the counter, and a midsole and outsole shown in a bottom view in FIG. 3C. In this embodiment the banding device 1 is shown before application to heel part of the area, and after attachment to heel part of the sole as at 12. The banding device 13 shows another embodiment before attachment to the toe and forefoot area, and then after attachment to the toe and forefoot area as at 14. In this embodiment the banding device may be removable or attached, and may be of different densities and material compounds as revealed in FIG. 2. A groove, channel, molded inset or carve out part 15 is shown on the midsole or outsole. The banding device will be printed, embossed, molded, or embroidered on one or both sides, and when reversed will reveal different color, design, team name, logo, character, or other indicia that is printed, embossed, painted, or otherwise affixed to the banding device.

Figure 4A:
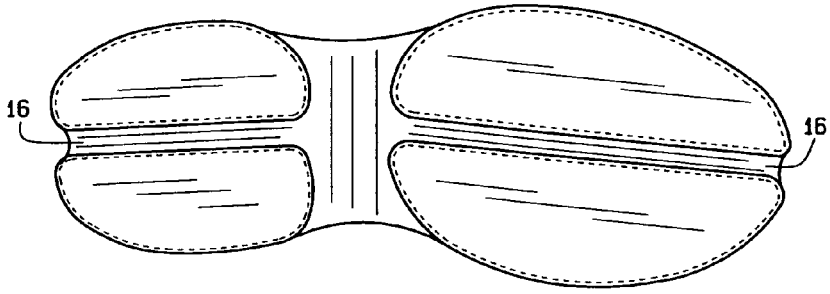
FIG. 4A is a bottom view of a shoe, with the banding device used in both the heel and toe/midfoot area as in FIG. 3, with an additional groove, channel, molded inset, or carve out or other indented means running length wise from toe to midfoot, and heel to midfoot, of provide a more custom usage of banding, be it for fashion changes, or a technical performance means shown in an oblique view in FIG. 4B.
Figure 4B:
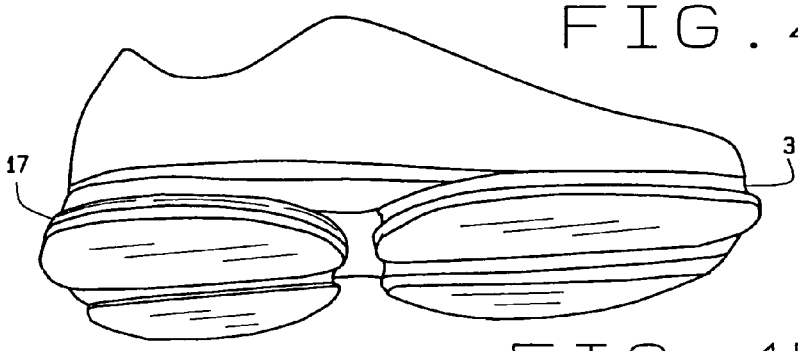

FIG. 4A is similar to FIG. 3 with the exception being an additional groove, channel, molded inset or carved out portion 16 on the midsole or outsole running lengthwise from toe to mid foot and again from midfoot to heel. The groves, channel, molded inset or carve out can be anywhere on the midsole. This embodiment reveals the banding device as applied to only the outside portion of the heel as at 17 in FIG. 4B. Conversely the banding device could be applied to only the inside of the heel, or for that matter the banding device could be applied to the entire heel with the contracting and expanding properties of the banding device. The same is applicable to the forefoot area, which will provide the wearer with multiple choices of fashion, or branding changes, or performance and custom applications depending on the density of the bands.

Figure 5A:
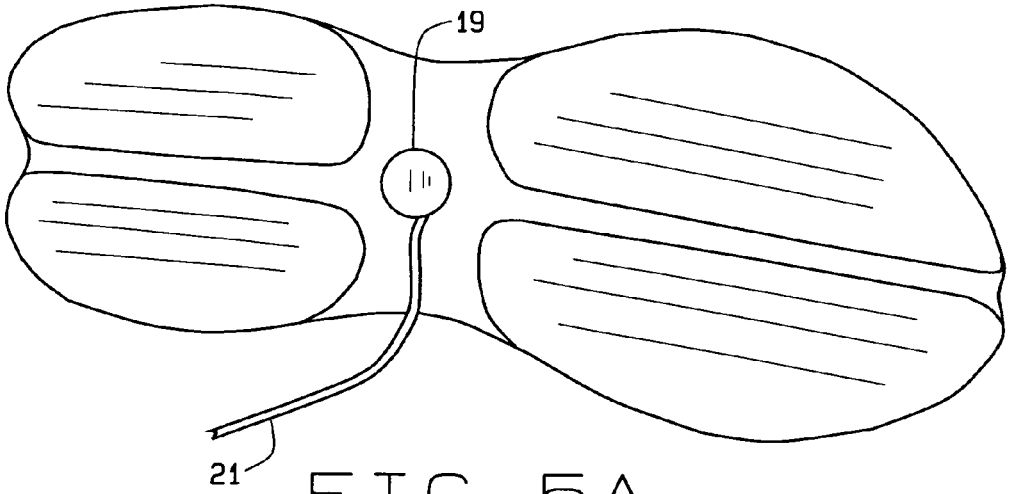
FIG. 5A is a bottom view of a sole, wherein, a spool or a winder device is part of the midsole/outsole molding process.
Figure 5B:
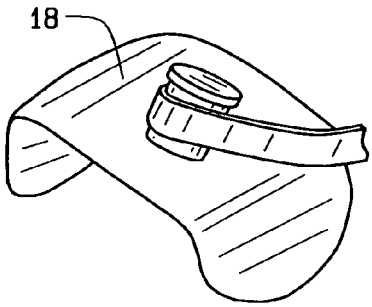
FIGS. 5B and 5C are detailed views of the spool or winder device that will allow the user to unwind the desired length of the banding and place around the desired area of the shoe, to provide a performance as well as a fashion change benefit.
Figure 5C:
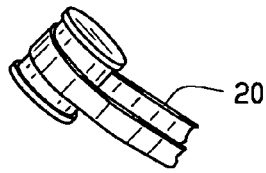

FIG. 5B reveals a cut away view 18 of the addition of a winder or spool device which could be a part of the molded midsole and/or outsole component. Also shown is the winder or spool device 19 in a finished environment of FIG. 5A. FIG. 5C shows the banding device as it would be stored on the winder or spool 20, and retracted or extended to wrap around various grooves, channels, molded insert or carve out in the midsole or outsole, at the preference of the wearer. As seen in 21 the end of the banding device would have an end piece of polymer or metal.

Figure 6:
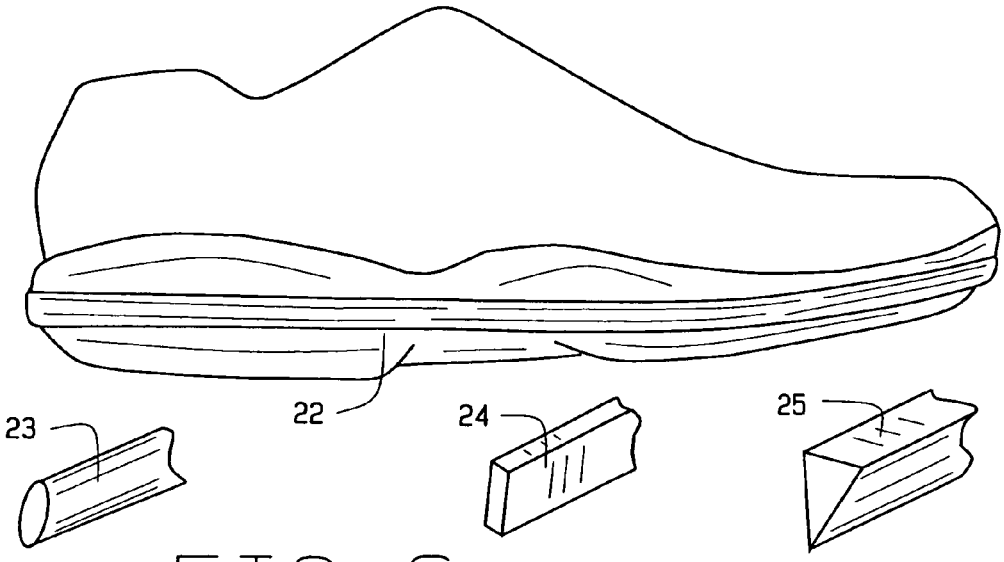
FIG. 6 is a side view of a shoe showing the banding device running the full length of the midsole and of different shapes of the banding are revealed in triangular, round, and square, flat, or rectangular shapes.

FIG. 6 is a full view of a shoe showing the banding device applicable to the full length of the shoe as at 22. Also revealed is the banding device in a circular cross section 23, while 24 shows a flat or rectangular cross section, and 25 reveals a triangular cross section. In fact the banding device can be manufactured in various shapes and configurations, for example in the shape of a registered trademark of a company. In this embodiment the banding device may be removable or permanently attached. The banding device will be printed, embossed, molded, or embroidered on one or both sides, and when reversed will reveal different color, design, team name, logo, character, or other indicia that is printed, embossed, painted, or otherwise affixed to the banding device.

Figure 7A:
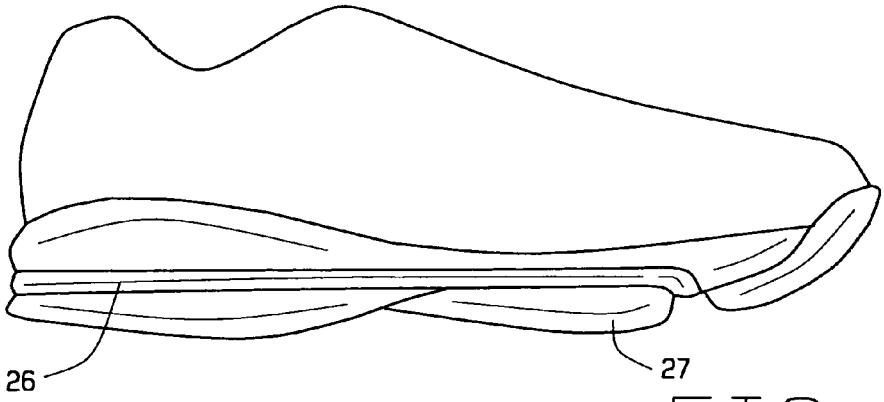
FIG. 7A is a side view of a shoe with the banding running ¾ length to the flex zone and underneath the foot part.
Figure 7B:
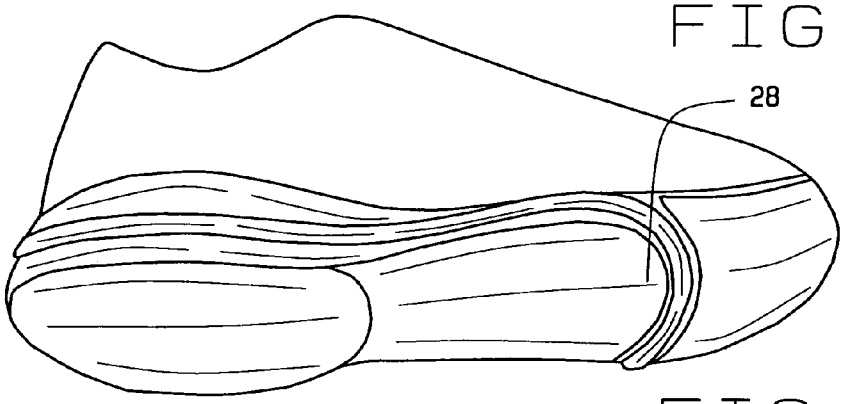
FIG. 7B is an oblique view of the sole of a shoe showing the storage of the banding in the flex zone will be in a non wear zone and a non abrasive area of the sole.

FIG. 7A is a side view of a full shoe showing the banding device at 26 before affixing to the midsole, and at 27 the banding device is affixed to the midsole running ¾ length and wrapping as at 28 under the forefoot specifically in the flex zone shown in FIG. 7B. With the banding device wrapping underneath the flex zone the wearer can select different density banding device as revealed in FIG. 2, to afford a custom performance fit, specific to a particular sport where more or less torque is required from the forefoot area to the heel. Additionally, this embodiment can allow for a more flexible performance for a shoe in the flex zone area.

Figure 8A:
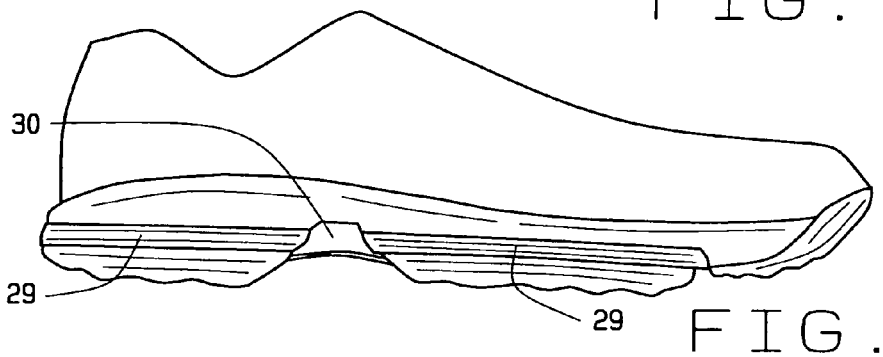
FIG. 8A is a side view of a shoe with two banding devices, wherein the front banding can rotate to secure at the heel area, and the heel area banding can rotate to secure to the toe area of the shoe.
Figure 8B:
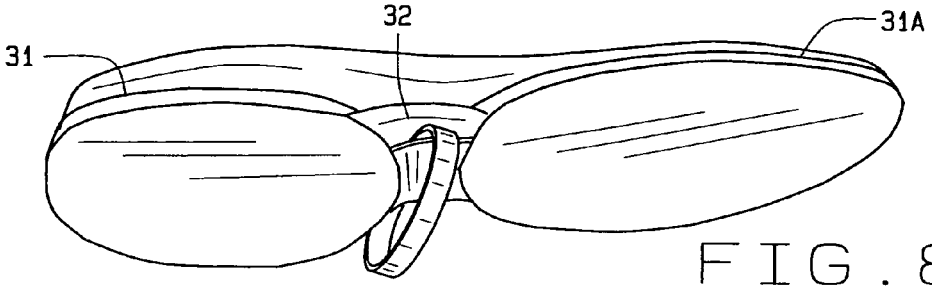
FIG. 8B is an oblique bottom view of a shoe showing at least one banding device looped into the sole for placement upon the heel, toe, or both areas of the shoe.

FIG. 8A is a full view of a shoe revealing the banding device 29 sliding through an open space or channel 30, wherein the banding device can be affixed to the heel area channel as at 31, molded inset or carve out, and can slide through the open space 32 in FIG. 8B or channel and be reaffixed to the midfoot channel 31 A, molded inset or carve out in the midsole. The open space or channel can have an opening to provide for a replacement banding device which is removable to suit the taste of the wearer of a shoe. Obviously, as mentioned above, the banding device will be printed, embossed, molded, or embroidered on one or both sides, and when reversed will reveal different color, design, team name, logo, character, or other indicia that is printed, embossed, painted, or otherwise affixed to the banding device.

Figure 9A:
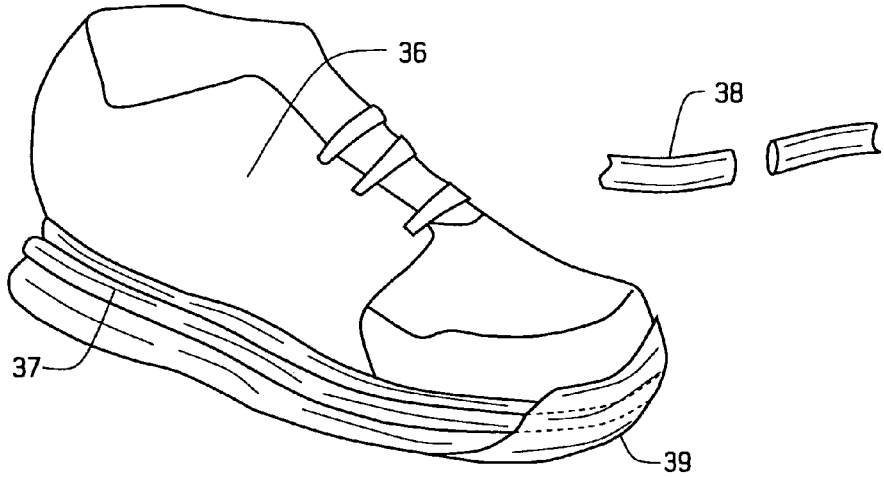
FIG. 9A is an oblique view of a shoe with the banding device with attachments at either end of the cord, which could allow for tension tightening or loosening of the banding at the preference of the wearer further, the banding runs underneath the front cupsole.
Figure 9B:
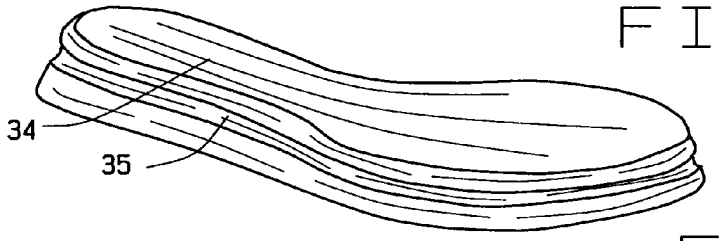
FIG. 9B is an oblique view of the midsole and FIG. 9C is an oblique view of the outsole with the banding before upper lasting and cementing with the midsole.
Figure 9C:
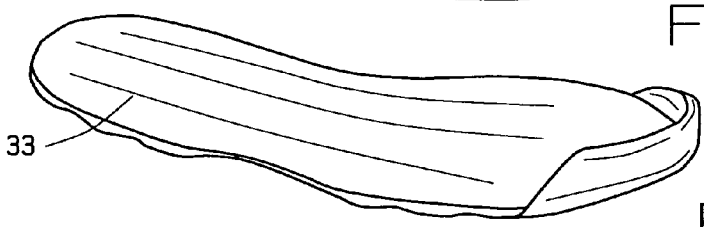

FIG. 9C reveals a front cup outsole 33, a midsole assembly 34, with a channel 35 in FIG. 9B, with a molded inset or carve out in the midsole, and a full view of a shoe 36 in FIG. 9A, with the affixed outsole 37, which is stitched and will avoid the wearing and abrasion to the banding device at the front or tip of the shoe. In this embodiment the banding device can be detached by the wearer from the sides or the rear of the shoe, and the banding device could be used as a means of stretching muscles before and after physical exercise to prevent injury. The banding device composite with the means of retracting and expanding will serve as a means for the wearer to pull the banding device in an upward, downward, or sideways motion for stretching and loosening up of one's muscles and tissues to again prevent injury and improve performance. As illustrated in FIG. 9A, the banding device 38 can be in two pieces with attachments at either end to facilitate the stretching means in this embodiment.

Figure 10B:
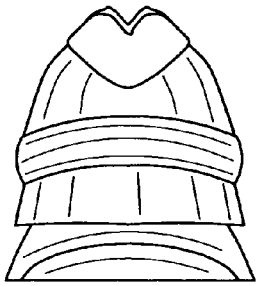
FIG. 10B is a rear view of a shoe where the groove, channel, molded inset, or carve out or other indented means extends across the outside counter.
Figure 10A:
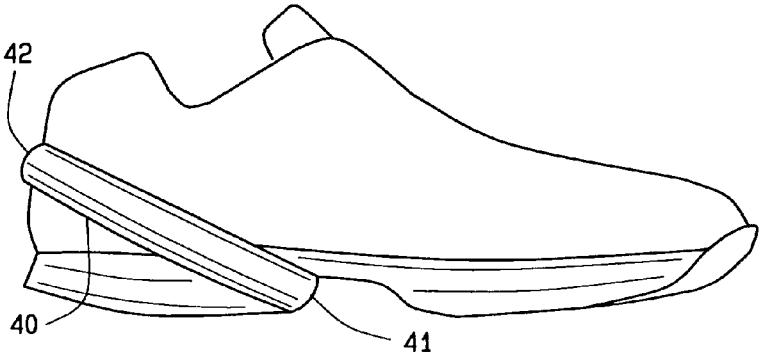
FIG. 10A is a side view of a shoe with the banding device running underneath the heel at an approximate 45 or other degree angle to wrap around the rear counter of the shoe.

FIG. 10A shows a full length shoe with the banding device 40 running at an approximate 45 degree angle, more or less from the under the heel area 41 to the mid rear counter 42 as also shown in FIG. 10B in a rear view. This embodiment will allow for a different fashion look wherein the banding device will be printed, embossed, molded, or embroidered on one or both sides, and when reversed will reveal different color(s); design; team name, logo, character, or other indicia that is printed, embossed, painted, or otherwise affixed to the banding device, whether in a permanent attachment or in a removable means with replacement banding devices for many other fashion changes or looks. In addition, the replacement banding device could be in different densities to afford a custom fit to heel counter area.

Figure 11A:
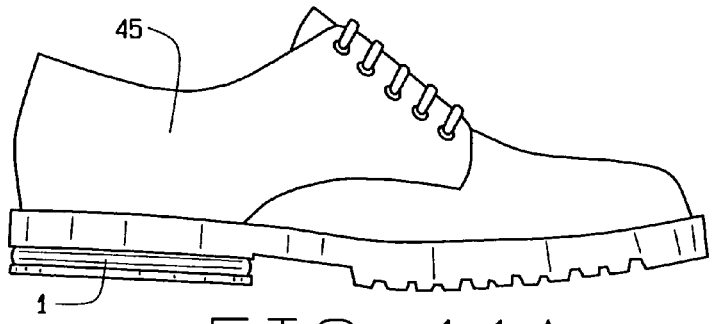
FIG. 11A is a side view of an oxford blucher shoe.
Figure 11C:
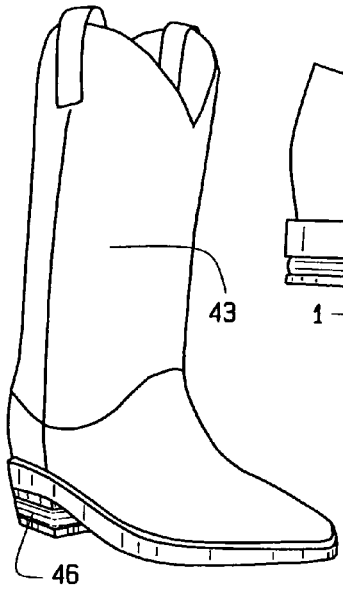
FIG. 11C is an oblique view of a western or cowboy boot, each using the banding device, that fits over the heel area.
Figure 11B:
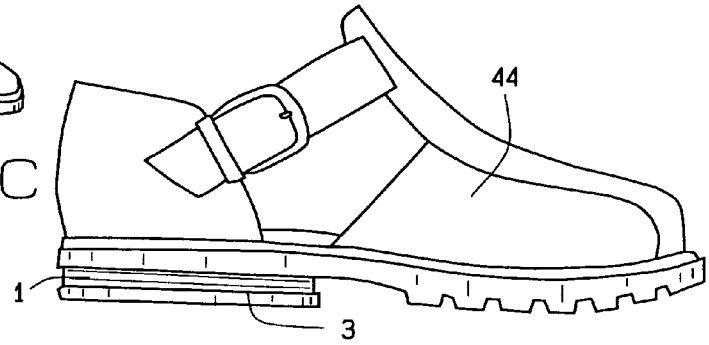
FIG. 11B is a side view of a sandal.

FIGS. 11A, 11B, 11C show three different types of shoes: a western, work, or cowboy boot 43 FIG. 11C, a sandal 44 FIG. 11B, and an oxford or casual shoe 45 FIG. 11A. As seen the banding device 45 can be of a different shape and used without a channel in the midsole or heel area of the shoe or boot. Another view of how the banding device 46 can be used without any channel or cut out is shown in FIG. 11C.

Figure 12:
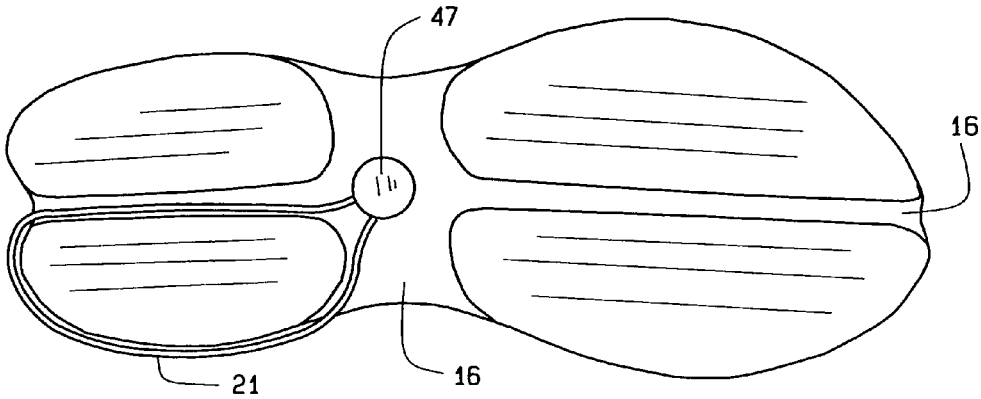
FIG. 12 is another bottom view showing the spool and/or winder device as illustrated in FIG. 5.

FIG. 12 is a more detailed bottom view of the midsole and outsole application as revealed in FIG. 5A, wherein a spool 47 or winder is used to facilitate storage of the banding device. In this environment the banding devices may be affixed to various positions in the channel, molded, inset or carved out in the midsole. The banding device will be printed, embossed, molded, or embroidered on one or both sides, and when reversed, will reveal different color(s) design, team name, logo, character, or other indicia that is printed, embossed, painted, or otherwise affixed to the banding device.

Figure 13A:
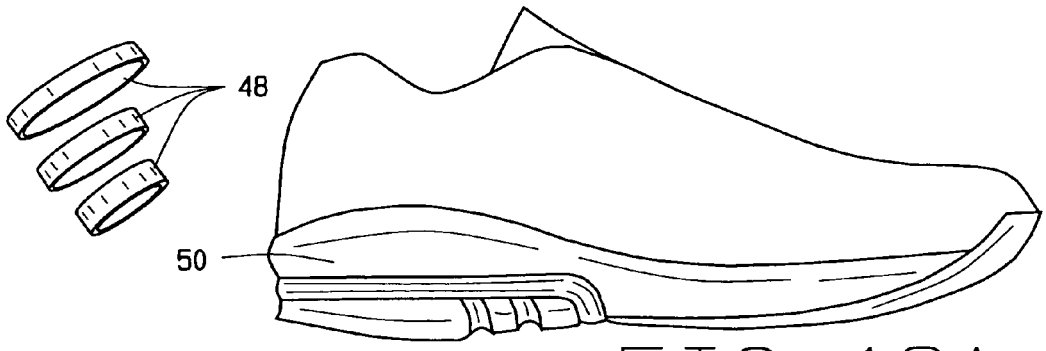
FIG. 13A is a side view of a shoe and various length banding devices applied to a groove in a heel of a shoe is a drawing where the groove has at least two transverse portions across the sole.
Figure 13B:
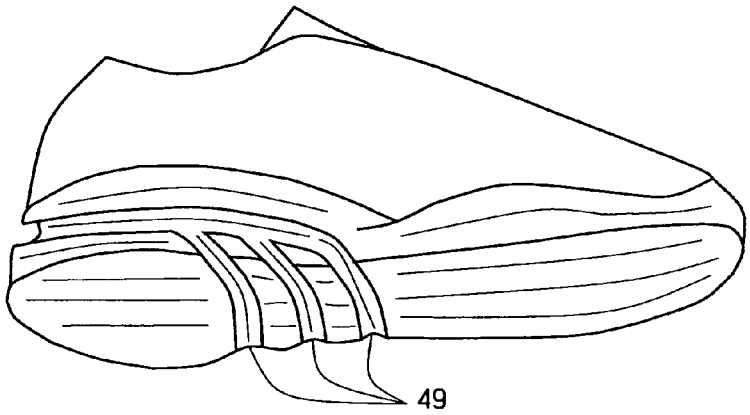
FIG. 13B is an oblique view of a shoe showing the groove in the sole with the transverse portions.

FIG. 13B shows a full length shoe where different size banding devices as at 49, can be used on the same shoe as shown in three different positioned cut out channels. The application 50 of the banding device appears in FIG. 13A where the banding device is applied to the longest channel. In this embodiment the wearer would have a vast selection of different fashion looks with the banding device printed, embossed, molded, or embroidered on one or both sides, and when reversed will reveal different color(s), design, team name, logo, character, or other indicia that is printed, embossed, painted, or otherwise affixed to the banding device. Conversely, the removable banding device may be formed of soft to firm density, which as shown in FIG. 13, can provide for a custom and performance fit.

Figure 14A:
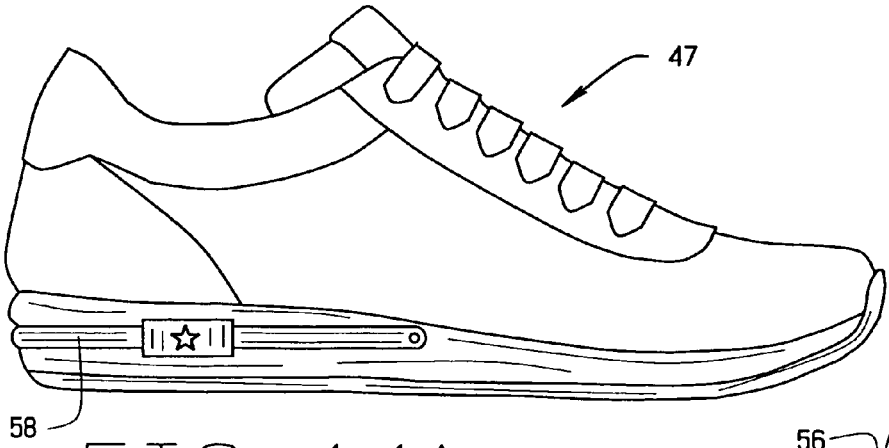
FIGS. 14A, B, C, D, E, F, and G show various views of the footwear having the banding device applied thereto, and which banding device can be applied for linking onto integral post provided upon the heels, during their application, in a wrap around style, and which banding device may have various affixed or sliding decorative items, such as a charm or jewelry including LED, applied thereto.
Figure 14B:
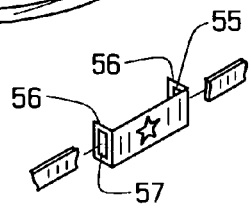
FIG. 14B is a detailed view of a charm or jewelry and the like upon the banding device.
Figure 14C:
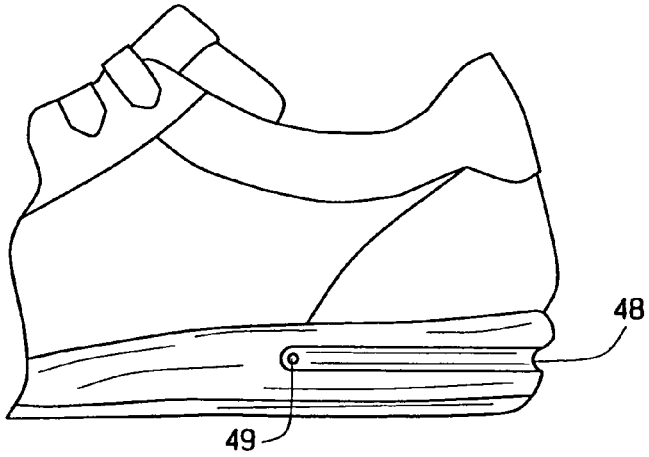
FIG. 14C is a view of the heel having a groove with post at the end of the groove.
Figure 14D:
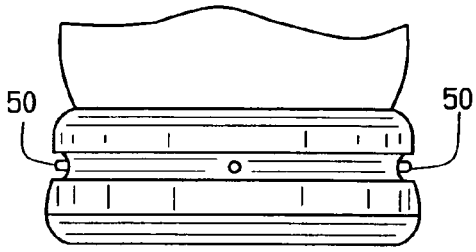
FIG. 14D is an end view of the heel showing posts at the ends of the groove.
Figure 14E:
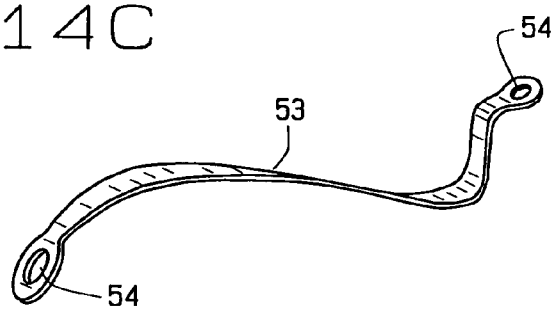
FIG. 14E is an oblique view of the band with loops for securement upon the posts.
Figure 14F:
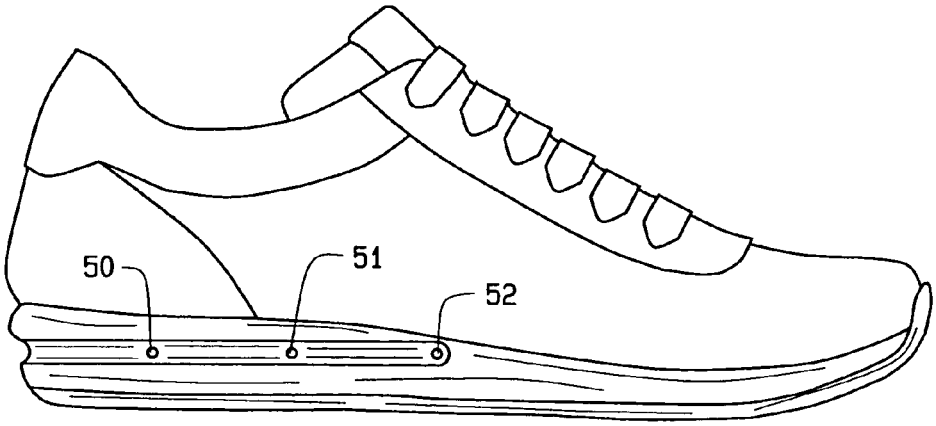
FIG. 14F is a side view of a shoe showing the groove with posts spaced along its length for bands of various lengths.

FIGS. 14A, 14B, 14C, 14D, 14E, 14F, and 14G show various views of footwear, such as a low cut athletic shoe 47, and a groove 48 may be applied around the back of the heel portion of the sole. Within the groove may be one or more integral posts, or pins, as at 49, 50, 51 or 52 shown in FIGS. 14C, 14D, 14F, provided on either side of the sole, and which will provide a fastening means to which the elastic banding device 53 will be applied as in FIG. 14A. In this particular configuration, the banding device will not be continuous, but will be formed of a length, having looped ends 54 for use for connecting upon the corresponding posts 49 through 52, depending upon the extent to which the banding device is to be applied, and its ability to stretch to the length required as shown in FIG. 14E. Also as can be noted in these figures, various types of ornamental devices, as at 55, may be applied to the bands, and function as jewelry, charms, or other types of decorative display, or show trademarks or other designs, can be applied onto the band, and be slid to any location desired, to add further aesthetics to the footwear, upon which the banding device of this invention is applied. It can be seen that the sliding type device 55 may have in turned ends, as at 56, having slots 57 provided therethrough in FIG. 14B, to facilitate their insertion onto the elastic band, as can be understood.

Once applied, the band, as shown at 58, is applied around the heel portion, or a segment thereof, for the shown shoe, during usage. It is also likely that similar types of length of the banding device could be applied at other locations about the sole, as around its front portion, or even over the top of the shoe, to function as a tie means, in lieu of the usage of any lacing, as can be seen, in a manner as previously described.

Figure 14G:
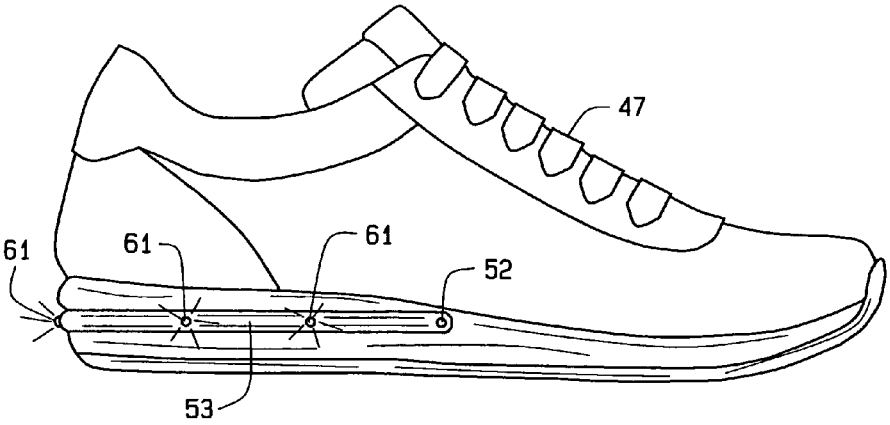
FIG. 14G is a side view of a shoe showing the banding device having LED spaced upon its length with the banding device positioned in a groove around the heel.

In an alternate embodiment shown in FIG. 14G, the band 53 has a plurality of Light Emitting Diodes, LED, as at 61, secured within the band as it is applied to the groove generally around the heel. As before, the band 53 secures to posts 52 at the ends of the groove towards the interior of the sole. The LED can be battery powered with a battery stored in a compartment within the sole or upon the counter. Alternatively, the LED can be powered from piezoelectric circuitry activated with each footfall of the shoe.

Figure 15A:
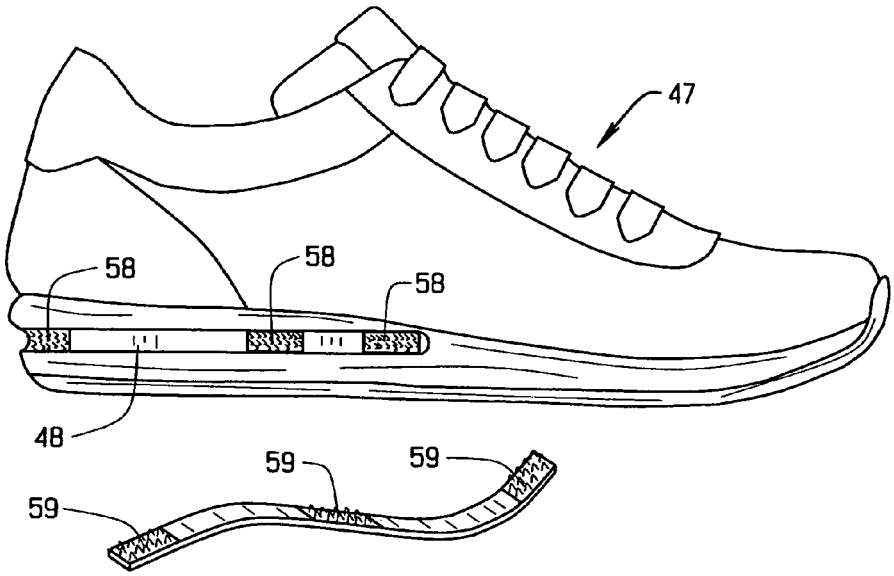
FIG. 15A is a side view of the footwear having the banding device applied thereto using cooperating hook and loop fasteners.

FIG. 15A shows a side view of footwear, such as a low cut athletic shoe 47, and a groove 48 may be applied around the back of the heel portion of the sole. Spaced within the groove, portions 58 of hook and loop fasteners join to the sole. The portions 58 have their counterparts upon the band 53. The band 53 has hook and loop fasteners in portions 59 located at each end of the band and spaced along the length of the band. The band is installed by securing one end 59 to a portion 58 at an end of the groove 48. The band is then stretched into the groove where the intermediate portions 59 adhere to the portions 58 spaced along the groove. The other end of the band is then secured on the opposite side of the groove to a portion 58 of hook and loop fastener.

Figure 15B:
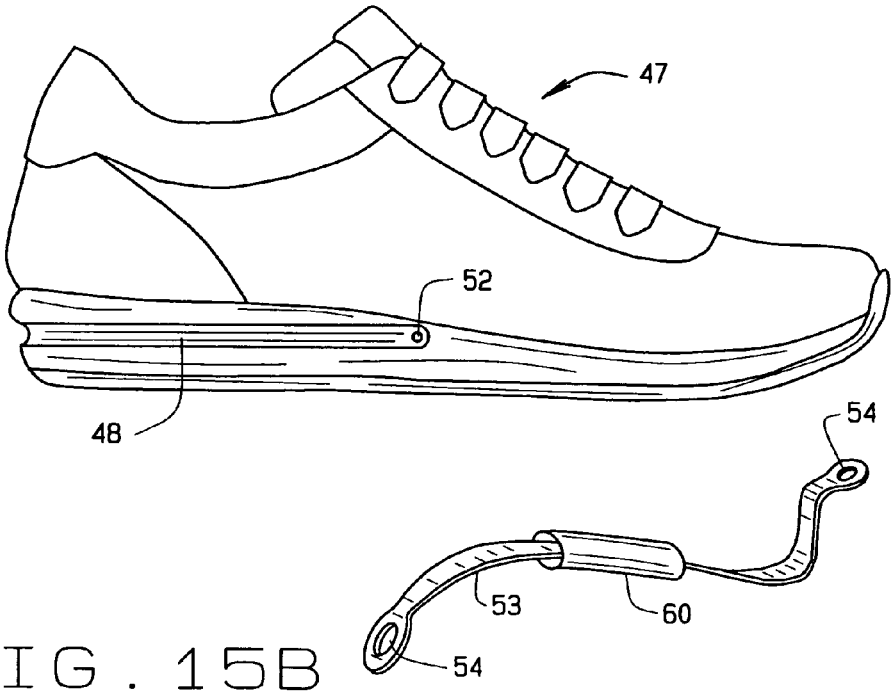
FIG. 15B is a side view of the footwear having the banding device applied thereto upon posts at each end with a moveable sleeve located upon the banding device.

Then FIG. 15B shows footwear in a side view, such as a tennis, running or other low cut athletic shoe, also with a groove 48 located around the back of the heel portion of the sole. In this embodiment, the groove 48 retains posts 52 at each end of the groove generally centered upon the sole. The band 53 has a flexible elongated form as before with two looped ends 54 that engage the posts. Located between the two ends 54, a sleeve 60 extends for a portion of the length of the band and enwraps the band. The sleeve has a diameter for a snug fit into the groove 48. The sleeve can be positioned at a desired place upon the band and then snapped into the groove. Moving the sleeve along the band reveals different portions of the band when the sleeve is transparent. The wearer of the footwear selects the location of the sleeve as desired. In another form, the sleeve is opaque with a color complementary to the sole. The opaque sleeve thus conceals a portion of the band at the discretion of the wearer of the footwear.

Figure 16A:
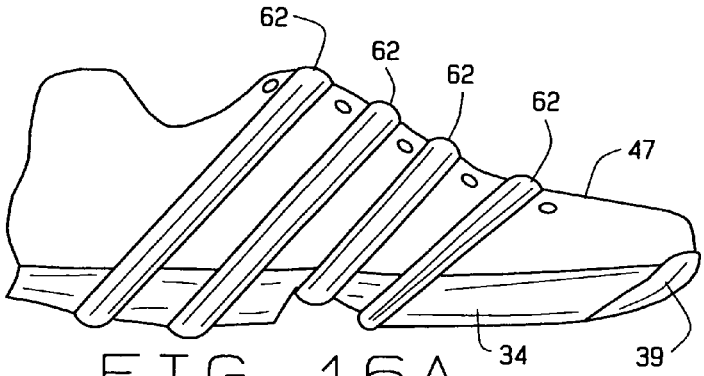
FIG. 16A is a side view of footwear, athletic footwear, having the banding device placed in multiple grooves within the sole and over the upper to replace laces.
Figure 16C:
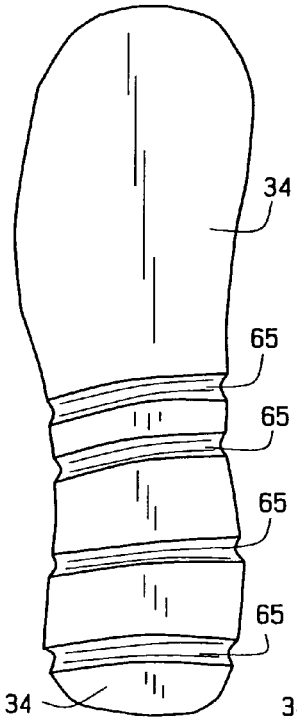
FIG. 16B is a side view of the footwear showing the grooves and locations upon the upper for the banding devices; and, FIG. 16C is a bottom view of the sole of the footwear showing the transverse grooves for installing the banding devices over the upper and down to the sole.
Figure 16B:
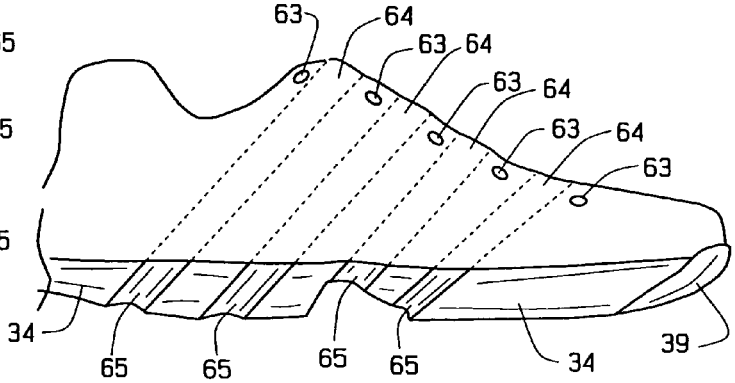

Another embodiment of the banding device upon footwear appears as an athletic shoe 47 in FIG. 16A. In this embodiment, the banding device 62 has a plurality of lengths that extend from the sole 34 over the vamp, functioning as a replacement for shoe laces and for altering the appearance of the shoe. The banding devices 62 occupy a series of grooves 64 upon the vamp generally parallel to each other and located between the eyelets 63 as shown in FIG. 16B. The grooves 65 extend into the sole 34 where the banding devices 62 firmly connect to the shoe. When viewed from the bottom as in FIG. 16C, the grooves 65 are also generally parallel to each other and transverse to the length of the sole 34. The grooves 65 have sufficient depth to receive a banding device 62 so that the banding device does not extend beyond the sole subject to abrasion when the shoe is worn. The plurality of banding devices 62 may have printing, color, indicia, other markings, ornamental devices, and the like as desired by the wearer. The banding devices may also include LED powered by battery or piezoelectric circuitry.

Variations or modifications to the subject matter of this invention may occur to those skilled in the art upon reviewing the disclosure as provided therein. Such variations, within the spirit of this development, are intended to be encompassed within the scope of any invention as provided herein. The description of the preferred embodiment as set forth herein is done so for illustrative purposes only.

We claim:

1. A banding system for footwear applied to at least one component of footwear, said component being one of the heel, sole, counter, and vamp, said banding system comprising:

at least one of said footwear components having at least one substantially continuous groove provided therein around its perimeter;

at least one continuous loop of elastic band stretching for application completely and contiguously within said continuous groove and provided for adding a color, design, or other indicia to the footwear upon which the banding system is applied; and said elastic band formed of material that contracts or expands as a means for affixing of the elastic band to the footwear component, and said elastic band being imprinted, embossed, molded, or embroidered on both sides, such that when it is reversed, will reveal a different color, design, team name, logo, character, or other indicia that has been applied thereon so that the elastic band can be stretched for application within the groove of the footwear component, and then reversed to expose its other side for varying the appearance of the footwear.

2. The banding device of claim 1 and wherein said elastic band has a cross section of one of round, rectangular, or triangular.

3. The banding device of claim 1 wherein said elastic band is applied to one of the heel, sole, or counter of the footwear.

4. The banding device of claim 3 wherein both said sole and heel have a continuous groove provided around its perimeter, and at least one continuous loop of elastic band stretching for application completely and contiguously within the continuous groove of the heel, and another continuous loop of elastic band stretching for application completely and contiguously within the grooves surrounding the sole of the footwear.

5. The banding system for footwear of claim 4, and including at least one channel extending longitudinally lengthwise of the footwear through the heel and sole portions of the footwear, and at least one continuous loop of elastic band stretching for application completely and contiguously within the periphery groove of the sole or heel, and applied centrally within the longitudinal channel of said heel and sole.

6. The banding device of claim 1 and wherein said heel has a longitudinal channel provided centrally therethrough, said groove of the heel extending continuously around said heel and through the longitudinal channel formed of said heel, and a continuous loop of elastic band stretching for application within the groove of said heel, and through its longitudinal channel, to provide for the adding of color, design, or other indicia to the footwear upon which the banding system is applied.

7. A banding system for footwear applied to at least one component of footwear, said component being one of the heel, sole, counter, and vamp, said banding system comprising:

at least one of said footwear components having at least one substantially continuous groove provided therein around its perimeter;

at least one continuous loop of elastic band stretching for application completely and contiguously within said continuous groove and provided for adding a color, design, or other indicia to the footwear upon which the banding system is applied; and said elastic band formed of material that contracts or expands as a means for affixing of the elastic band to the footwear component, said elastic band being imprinted, embossed, molded, or embroidered on at least one side, so that the elastic band can be stretched for application within the groove of the footwear component to add to the appearance of the footwear during usage.

8. The banding system of claim 7 and including a series of elastic bands, one elastic band may be replaced from the footwear component, and another elastic band applied in its place, to vary the color, design, or other indicia for the footwear upon which the banding system is applied.

* * * * *